US008033626B2

(12) United States Patent
Hu et al.

(10) Patent No.: US 8,033,626 B2
(45) **Date of Patent: *Oct. 11, 2011**

(54) INK JET PRINTHEAD MODULE AND INK JET PRINTER

(75) Inventors: Hung-Lieh Hu, Hsinchu (TW); Jui-Hua Hu, Taichung County (TW); Francis Chee-Shuen Lee, Hsin-Chu (TW); Wei-Fu Lai, Taichung County (TW)

(73) Assignee: International United Technology Co., Ltd., Hsin-chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/955,890

(22) Filed: Nov. 29, 2010

(65) Prior Publication Data

US 2011/0074847 A1 Mar. 31, 2011

Related U.S. Application Data

(60) Division of application No. 11/854,528, filed on Sep. 12, 2007, now Pat. No. 7,922,276, which is a continuation-in-part of application No. 10/709,767, filed on May 27, 2004, now Pat. No. 7,284,809.

(30) Foreign Application Priority Data

Apr. 8, 2004 (TW) ..... 93109684 A

(51) Int. Cl.
*B41J 29/38* (2006.01)
*B41J 2/05* (2006.01)

(52) U.S. Cl. ..... 347/9; 347/12; 347/57

(58) Field of Classification Search ..... 347/9, 12, 347/57

See application file for complete search history.

(56) References Cited

U.S. PATENT DOCUMENTS

| | | | | |
|---|---|---|---|---|
| 7,547,083 | B2 * | 6/2009 | Hu et al. | 347/9 |
| 2002/0118235 | A1 * | 8/2002 | Narazaki et al. | 347/5 |
| 2004/0109036 | A1 * | 6/2004 | Han | 347/12 |

* cited by examiner

*Primary Examiner* — Matthew Luu
*Assistant Examiner* — Jannelle M Lebron
(74) *Attorney, Agent, or Firm* — Jianq Chyun IP Office

(57) ABSTRACT

An ink jet printhead module adapted for use in a printing apparatus, the ink jet printhead module being capable of receiving address signals and chip selection signals from a printhead drive unit of the printing apparatus. The printhead module includes chip control circuits, each being capable of receiving the address signals and receiving a corresponding one of the chip selection signals. Each chip control circuit includes switching circuits and an ink jetting circuit set. Each switching circuit is capable of receiving a corresponding one of the address signals and the corresponding one of chip selection signals and outputting a switching signal. An ink jetting circuit set includes ink jetting circuits, each being capable of receiving the switching signal from the corresponding switching circuit electrically coupled to the ink jetting circuit and determining whether or not to jet out ink based on the received switching signal.

7 Claims, 13 Drawing Sheets

| Input Signals | | Output Decoding Signals | | | |
|---|---|---|---|---|---|
| input 1 | input 2 | output 1 | output 2 | output 3 | output 4 |
| Voltage Low | Voltage Low | outputting selection signal | Voltage Low | Voltage Low | Voltage Low |
| Voltage Low | Voltage High | Voltage Low | outputting selection signal | Voltage Low | Voltage Low |
| Voltage High | Voltage Low | Voltage Low | Voltage Low | outputting selection signal | Voltage Low |
| Voltage High | Voltage High | Voltage Low | Voltage Low | Voltage Low | outputting selection signal |

FIG. 13

INK JET PRINTHEAD MODULE AND INK JET PRINTER

CROSS-REFERENCE TO RELATED APPLICATION

This application is a divisional application of and claims the priority benefit of U.S. application Ser. No. 11/854,528, filed on Sep. 12, 2007, now allowed, which is a continuation-in-part of an application Ser. No. 10/709,767, filed on May 27, 2004, now U.S. Pat. No. 7,284,809, issued Oct. 23, 2007. The prior application Ser. No. 10/709,767 claims the priority benefit of Taiwan application serial no. 93109684, filed on Apr. 8, 2004. The entirety of each of the above-mentioned patent applications is hereby incorporated by reference herein and made a part of this specification.

BACKGROUND OF THE INVENTION

1. Field of the Invention

This invention generally relates to an ink jet printhead module, and more particularly to an ink jet printhead module of an ink jet printer having multiple chip control circuits.

2. Description of Related Art

Computers are widely used in the present era. In addition to displaying the data or images processed by the computer on the display, there are several ways to output the data or images. A printer is one of the most common output devices which can output the text, data, graphics, etc. on the papers.

Currently, the printers can be generally classified into dot-matrix printers, ink jet printers, and laser printers. Each of these three printers has its own advantages. Hence, users can choose different printers based on their need.

A cartridge installed in an ink jet printer can contain ink with one or more different colors. The cartridge jets out the drops of ink via the nozzles onto the paper to form the texts, lines, or graphics. Some photo ink jet printers even have the cartridges with pink or pink blue ink for printing images with more colors.

FIG. 1 is an inkjet drive circuit disclosed in the U.S. Pat. No. 6,299,292. As shown in FIG. 1, the drive circuit includes 16 printhead arrays 105. Each printhead array 105 includes 13 heaters H. After the decoder 109 receives the print command, it will send out the address decoding signal of the printhead based on the print command to heat up the heaters H corresponding to the specific addresses so that the ink will be heated and jetted out via the nozzle.

The decoder 109 will send out the printhead array address signals AD1-AD16 and the heater address signals A1-A13. The printhead array address signals AD1-AD16 will determine which printhead array 105 will be driven. The heater address signals A1-A13 will determine which heater H in the specific printhead array 105 will heat the ink. The first terminal of the heater H receives the voltage signal V and the second terminal of the heater H will be controlled by two switches to determine whether current passes through that heater. These two switches comprise MOSFETs 101 and 103. The gate of the MOSFET 103 receives the printhead array address signal; the source (when the MOSFET is a CMOS) receives the heater address signal. When the source and the gate of the MOSFET 103 are enabled at the same time, the drain (when the MOSFET is a CMOS) will generate current signal and send it to the gate of the MOSFET 101. At the time the source-drain of the MOSFET 101 will be turned on when the voltage signal V is supplied, and the heater H will heat the ink and the ink is ready to be jetted out.

FIG. 2 is the inkjet drive circuit disclosed in the U.S. Pat. No. 5,867,183. As shown in FIG. 2, the inkjet drive circuit includes the inkjet printhead drive unit 201 and the printhead ink output units 211 and 213. The inkjet printhead drive unit 201 includes the inkjet printhead drive circuit 203 and the printhead selection circuit 205. The inkjet printhead drive circuit 203 outputs a set of bus control signals 207 and the printhead selection circuit 205 outputs a set of bus selection signal 209 selectively to enable one of the printhead ink output units. The control signals 207 and the corresponding selection signal will determine whether to enable the nozzles of one of the printhead ink output units.

The printhead ink output unit 211 includes the enable circuit 215, the nozzle jetting circuits 225-231 and the nozzle 233. The enable circuit 215 includes a plurality of MOSFETs 217, 219, 221 and 223. The drain (current input) of each MOSFET will receive the corresponding control signal in the bus control signal set 203. The gate (command input) of each MOSFET will receive the corresponding selection signal in the bus selection signal set 209. When the drain and the gate of the same MOSFET are enabled at the same time, the source (output terminal, current output) will generate a current signal to drive the coupled nozzle jetting circuit. For example, the MOSFET 217 is coupled to the nozzle jetting circuit 225 and the MOSFET 219 is coupled to the nozzle jetting circuit 227. Then the nozzle jetting circuit will jet out the ink out of the nozzle 233. The printhead ink output unit 213 works the same as the printhead ink output unit 211.

SUMMARY OF THE INVENTION

The embodiments of the present invention are directed to an ink jet printhead module having a plurality of chip control circuits selectively enabled by a plurality of address signals provided by an ink jet printing system and a chip selection signal provided directly or indirectly by the ink jet printing system to determine whether or not to jet out ink.

The embodiments of the present invention are directed to an ink jet printer with at least one ink jet printhead module having a plurality of chip control circuits selectively enabled by a plurality of address signals provided by an ink jet printing system and a chip selection signal provided directly or indirectly by the ink jet printing system to determine whether or not to jet out ink.

One or part or all of these and other features and advantages of the present invention will become readily apparent to those skilled in this art from the following description wherein there is shown and described embodiments of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

One of the embodiments of the present invention provides an ink jet printhead module adapted for use in a printing apparatus. The ink jet printhead module is capable of receiving a plurality of address signals and a plurality of chip selection signals from a printhead drive unit of the printing apparatus. The ink jet printhead module includes a plurality of chip control circuits. Each of the chip control circuits is capable of receiving the address signals and a corresponding one of the chip selection signals. Each of the chip control circuits includes a plurality of switching circuits and an ink jetting circuit set. Each of the switching circuits is capable of receiving a corresponding one of the address signals and the corresponding one of the chip selection signals and outputting a switching signal. The ink jetting circuit set includes a plurality of ink jetting circuits. Each of the ink jetting circuits is capable of receiving the switching signal from the corresponding switching circuit electrically coupled to the ink jetting circuit and determining whether or not to jet out ink based on the received switching signal. The corresponding one of the address signals and the corresponding one of the chip selection signals have a voltage level of a logic high voltage level and a logic low voltage level. The switching signal is a logic high voltage level and selectively enables the ink jetting circuit when the corresponding one of the address signals and the corresponding one of the chip selection signals are at the logic high voltage level.

Still another one of the embodiments of the present invention provides an ink jet printer. The ink jet printer includes a printhead drive unit and at least one ink jet printhead module. The printhead drive unit includes a printhead drive circuit and a printhead selection circuit. The printhead drive circuit is capable of outputting a plurality of address signals, and the printhead selection circuit is capable of outputting a plurality of chip selection signals. The ink jet printhead module is capable of receiving the address signals and the chip selection signals. The ink jet printhead module comprises a plurality of chip control circuits. Each of the chip control circuits is capable of receiving the address signals and a corresponding one of the chip selection signals. Each of the chip control circuits comprises a plurality of switching circuits and an ink jetting circuit set. Each of the switching circuits is capable of receiving a corresponding one of the address signals and the corresponding one of the chip selection signals and outputting a switching signal. The ink jetting circuit set includes a plurality of ink jetting circuits. Each of the ink jetting circuits is capable of receiving the switching signal from the corresponding switching circuit electrically coupled to the ink jetting circuit and determining whether or not to jet out ink based on the received switching signal. The corresponding one of the address signals and the corresponding one of the chip selection signals have a voltage level of a logic high voltage level and a logic low voltage level. The switching signal is a logic high voltage level and selectively enables the ink jetting circuit when the corresponding one of the address signals and the corresponding one of the chip selection signals are at the logic high voltage level.

In an embodiment of the present invention, each of the switching circuits comprises a first inverter and a second inverter electrically coupled in series, the first inverter receives the corresponding one of the chip selection signals, each of the inverters receives the same corresponding one of the address signals, and the second inverter outputs the switching signal.

In light of the above, one of the chip control circuits in an ink jet printhead module of the embodiments of the present invention can be selectively enabled to jet out ink by using multiple switching circuits for receiving address signals and a chip selection signal having a logic high voltage level and a logic low voltage level.

BRIEF DESCRIPTION OF THE DRAWINGS

FIG. 13 is the true-false table of the demultiplexer circuit indicated in FIG. 12.

DESCRIPTION OF THE EMBODIMENTS

Figure 1:
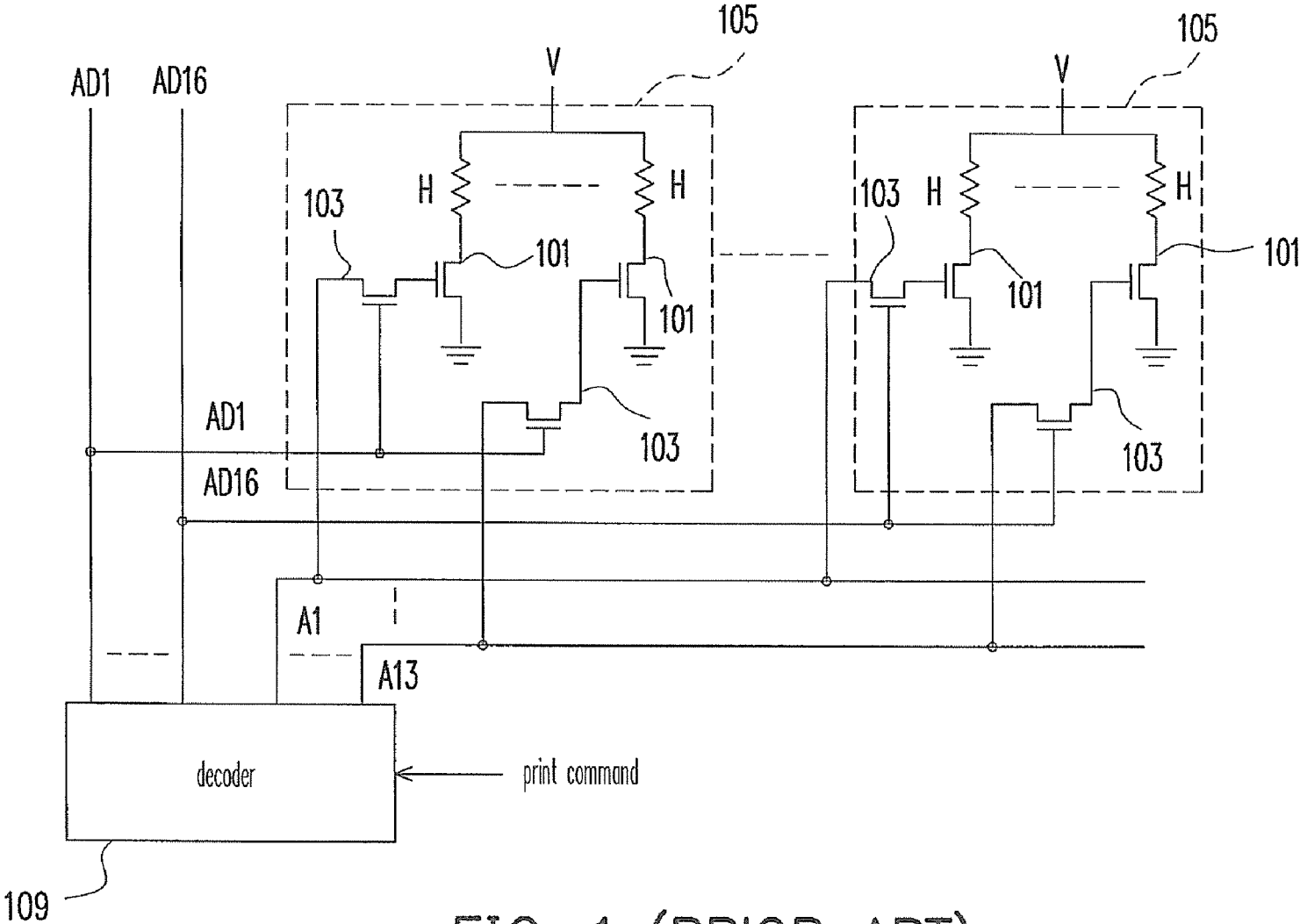
FIG. 1 (PRIOR ART)
FIG. 1 is a circuit diagram of a conventional inkjet drive circuit.
Figure 2:
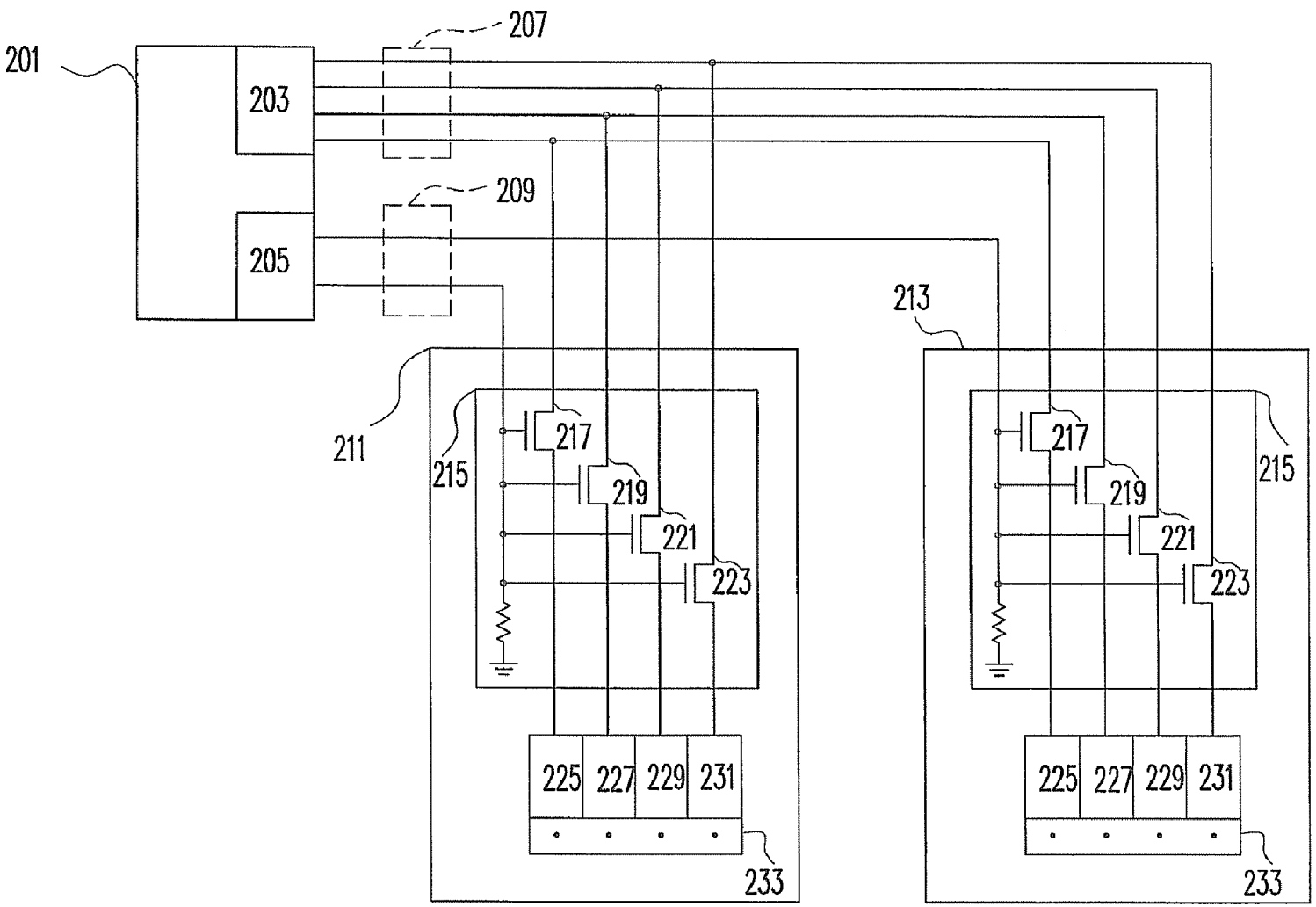
FIG. 2 (PRIOR ART)
FIG. 2 is another circuit diagram of a conventional inkjet drive circuit.
Figure 3:
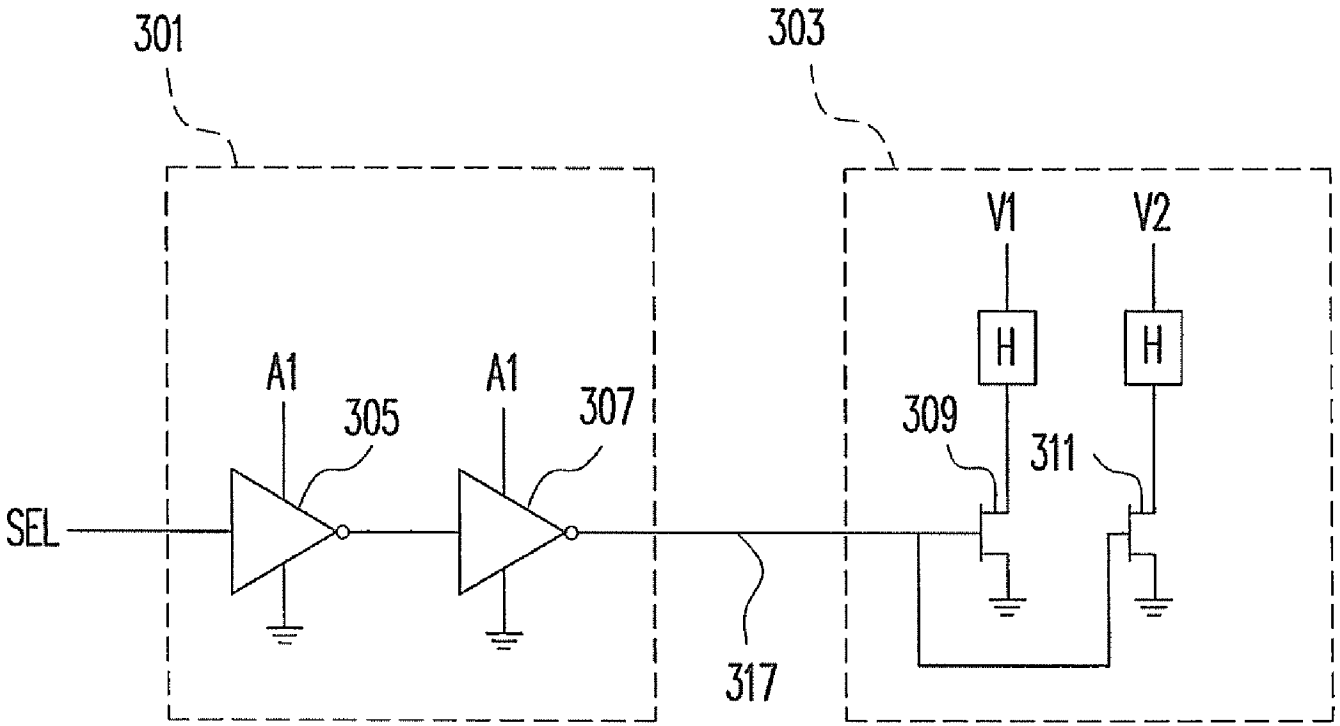
FIG. 3 is a circuit diagram of a printhead controller in accordance with an embodiment of the present invention.

FIG. 3 is a circuit diagram of a printhead controller in accordance with an embodiment of the present invention. As shown in FIG. 3, the printhead controller implemented within a printhead includes the buffer circuit 301 and the ink jetting circuit 303. The buffer circuit 301 includes the inverters 305 and 307 connected in series. The working driving voltages of these two inverters are controlled by the same address signal A1. The address signal A1 has a voltage level of a logic high voltage level and a logic low voltage level. The input terminal of the inverter 305 receives and inverts the selection signal SEL. Then the inverter 305 outputs the inverted signal via the output terminal of the inverter 305 to the inverter 307. After the inverse operation by the inverter 307, the buffer signal is outputted from the output terminal of the inverter 307 to the ink jetting circuit 303 via the transmission line 317. Here, as can been understood, the buffer signal output from the buffer circuit 301 is to switch the on/off status of the MOSFETs 309 and 311. Therefore, the buffer circuit 301 can be regarded as a switching circuit having a plurality of inverters connected in series to selectively enable the corresponding ink jetting circuit 303 electrically coupled to the buffer circuit 301. The buffer signal can be regarded as a switching signal.

The ink jetting circuit 303 includes a plurality of MOSFETs. In FIG. 3, the ink jetting circuit 303, for example, includes two MOSFETs 309 and 311. The gates of the MOSFETs 309 and 311 receive the buffer signal form the inverter 307. When the buffer signal received by the ink jetting circuit 303 is at the high voltage level, the MOSFETs 309 and 311 are turned on and the heaters H will heat the ink up for jetting ink out via the corresponding nozzles of the cartridge depending on the status of voltages V1 and V2. In this embodiment, the buffer signal received by the ink jetting circuit 303 is the voltage signal. In other words, the on/off of MOSFETs in the ink jetting circuit 303 depends on the voltage level. The MOSFETs can also be driven by current by adding a resistor on the transmission line 317 and coupling it to the ground.

Figure 4:
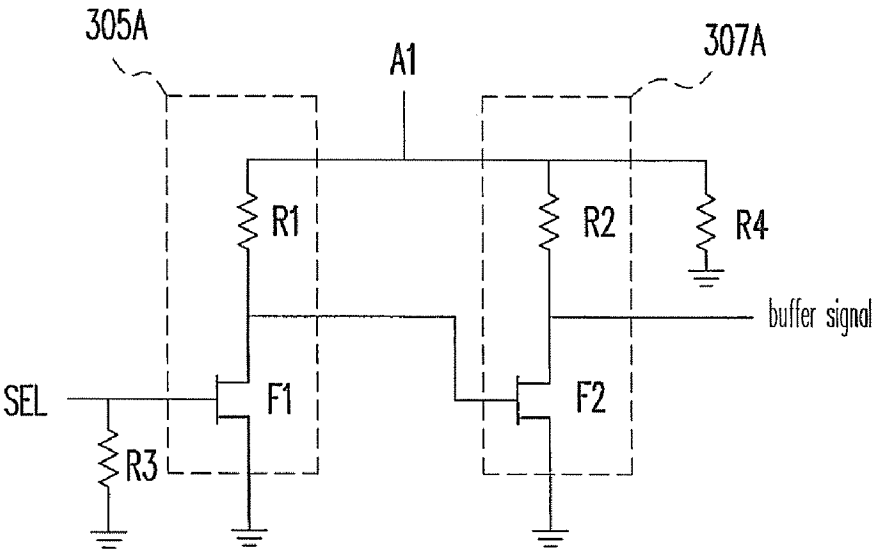
FIG. 4 is a circuit diagram of a buffer circuit in accordance with an embodiment of the present invention.

FIG. 4 is a circuit diagram of a buffer circuit in accordance with an embodiment of the present invention. As shown in FIG. 4, the buffer circuit includes two inverters 305A and 307A. The inverter 305A includes the MOSFET F1 and the resistor R1, and the inverter 307A includes the MOSFET F2 and the resistor R2. The driving voltage of these two inverters is controlled by the address signal A1. The gate of the MOSFET F1 of the inverter 305A is coupled in series with the resistor R3 and then coupled to the ground. The gate of the MOSFET F1 receives the selection signal SEL to determine whether or not to turn on MOSFET F1 in order to output the corresponding inverted signal. The gate of the MOSFET F2 of the inverter 307A receives the inverted signal and then outputs the corresponding buffer signal in order to determine the subsequent operation of the circuit. In this embodiment, as shown in FIG. 4, the resistors R1 and R2 range from 0.5 kΩ to 500 kΩ. The preferred resistance of the resistors R1 and R2 range from 20 kΩ to 80 kΩ. The resistors R3 and R4 range from 1 kΩ to 500 kΩ. The preferred resistance of the resistors R1 and R2 ranges from 20 kΩ to 80 kΩ.

Figure 5:
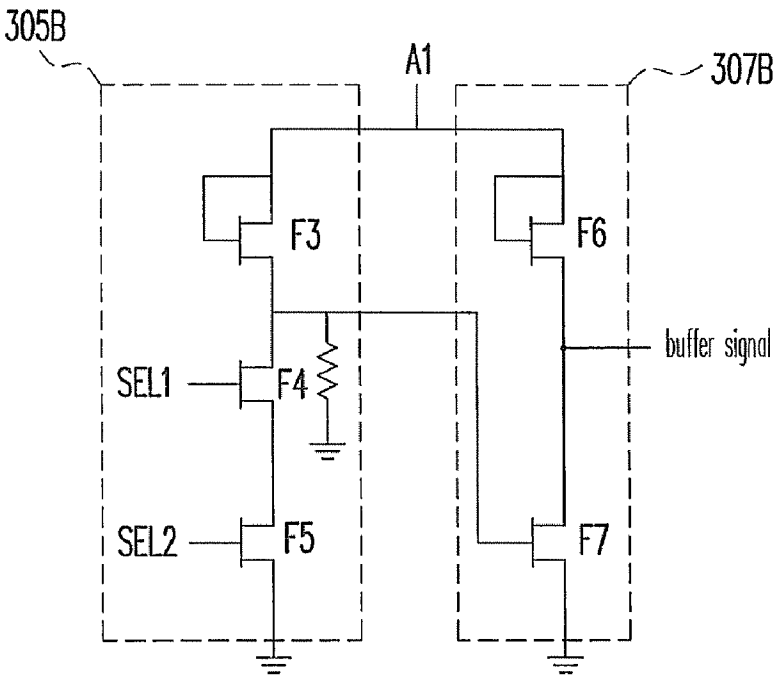
FIG. 5 is a circuit diagram of a buffer circuit in accordance with another embodiment of the present invention.

FIG. 5 is a circuit diagram of a buffer circuit in accordance with another embodiment of the present invention. As shown in FIG. 5, the buffer circuit includes two inverters 305B and 307B, each of which consists of MOSFETs. The inverter 305B includes the MOSFETs F3, F4 and F5 connected in series; the inverter 307B includes the MOSFETs F6 and F7. The difference between this embodiment and the embodiment in FIG. 4 is that the buffer circuit in this embodiment can receive two selection signals SEL1 and SEL2. The inverter 307B then outputs the corresponding buffer signal based on the statuses of these two selection signals SEL1 and SEL2.

In the inverter 305B, the drain and the gate of MOSFET F3 are coupled to each other to form the drain feedback. The drain of MOSFET F3 receives the address signal A1; the source of MOSFET F3 is coupled to the drain of MOSFET F4 and outputs the inverted signal. The gate of MOSFET F4 receives the selection signal SEL1; the source of MOSFET F4 is coupled to the drain of MOSFET F5. The gate of MOSFET F5 receives the selection signal SEL2; the source of MOSFET F5 is grounded. When one of the selection signals SEL1 and SEL2 is at the low voltage level, one of the MOSFETs cannot be turned on. Hence, the inverted signal is at the high voltage level if the address signal A1 is at the high voltage level. On the other hand, when both of the selection signals SEL1 and SEL2 are at the high voltage level, the inverted signal is at the low voltage level. The MOSFET F3 in the inverter 305B can be replaced by the resistor R1 in FIG. 4. Further, in this embodiment, the selection signal SEL2 received by the MOSFET F5 can be replaced by the address signal A1 and the same result can be achieved (i.e., when MOSFET F4 and MOSFET F5 receive the high voltage signals, the inverted signal is at the low voltage level).

In the inverter 307B, like the MOSFET F3, the drain and the gate of MOSFET F6 are coupled to each other to form the drain feedback. The source of MOSFET F6 is coupled to MOSFET F7 and outputs the buffer signal according to the inverted signal. The gate of MOSFET F7 receives the inverted signal and the source of MOSFET F7 is grounded. In one embodiment, the selection signal SEL2 can be used with the selection signal SEL1 for a purpose of further protection, so as to ensure the buffer signal to be properly output according to the address signal A1 and the selection signal SEL1.

When the buffer circuit is required to receive more selection signals for determination, one skilled in the art can connect the other MOSFETs to MOSFET F5 in the inverter 305B in series and input the new added selection signals (or address signals) to the gates of the new added MOSFETs to satisfy the requirement of inputting more selection signals in an specific embodiment.

Figure 6:
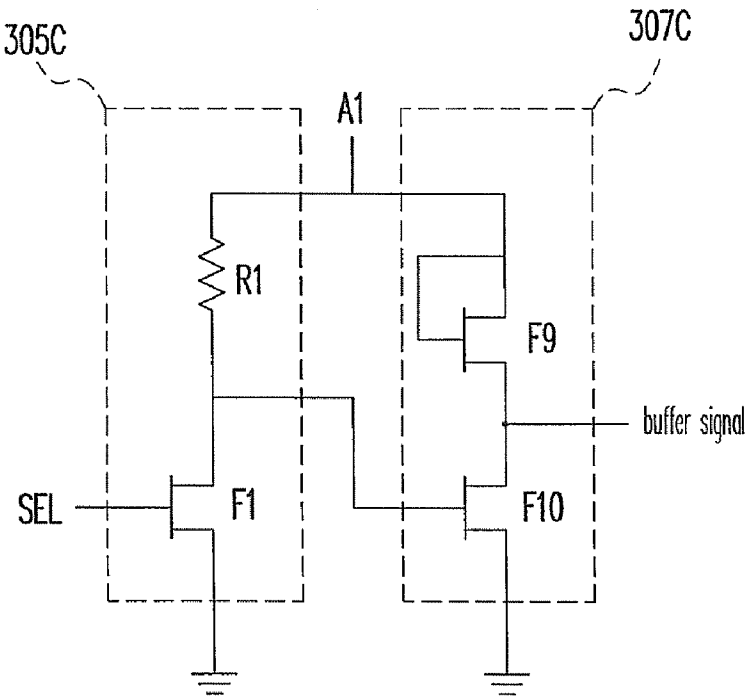
FIG. 6 is a circuit diagram of a buffer circuit in accordance with still another embodiment of the present invention.

FIG. 6 is a circuit diagram of a buffer circuit in accordance with still another embodiment of the present invention. As shown in FIG. 6, the buffer circuit includes two inverters 305C and 307C, wherein the inverter 305C is same as the inverter 305A. In the inverter 307C, the gate and the drain of MOSFET F9 are coupled to each other to form the drain feedback. The drain of MOSFET F9 receives the address signal; the source of MOSFET F9 is coupled to the drain of MOSFET F10 and outputs the buffer signal. The gate of MOSFET F10 receives the inverted signal from the inverter 305C and determines whether or not to turn on/off MOSFET F10 based on the voltage level of the inverted signal. The source of MOSFET F10 is grounded.

Figure 7:
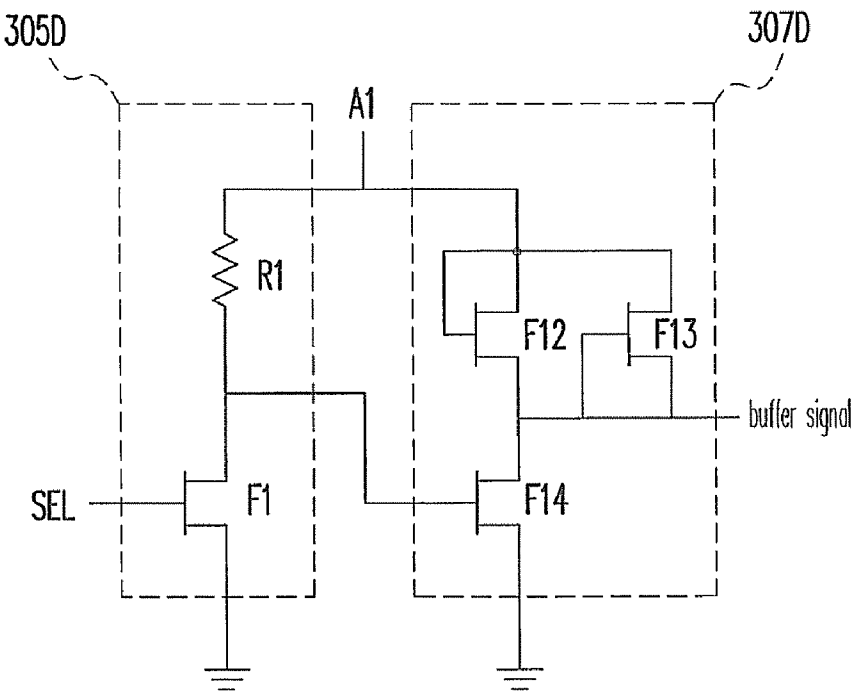
FIG. 7 is a circuit diagram of a buffer circuit in accordance with further still another embodiment of the present invention.

FIG. 7 is a circuit diagram of a buffer circuit in accordance with still another embodiment of the present invention. As shown in FIG. 7, the buffer circuit includes two inverters 305D and 307D, wherein the inverter 305D is the same as the inverter 305A. In the inverter 307D, the drain of MOSFET F12 receives the address signal; and the gate and the drain of MOSFET F13 are coupled to each other. The source of MOSFET F13 outputs the buffer signal. The gate and the source of MOSFET F13, the source of MOSFET F12, and the drain of MOSFET F14 are coupled together. The gate of MOSFET F14 receives the inverted signal from the inverter 305D to determine whether or not to turn on/off MOSFET F14. The source of MOSFET F14 is grounded.

Figure 8:
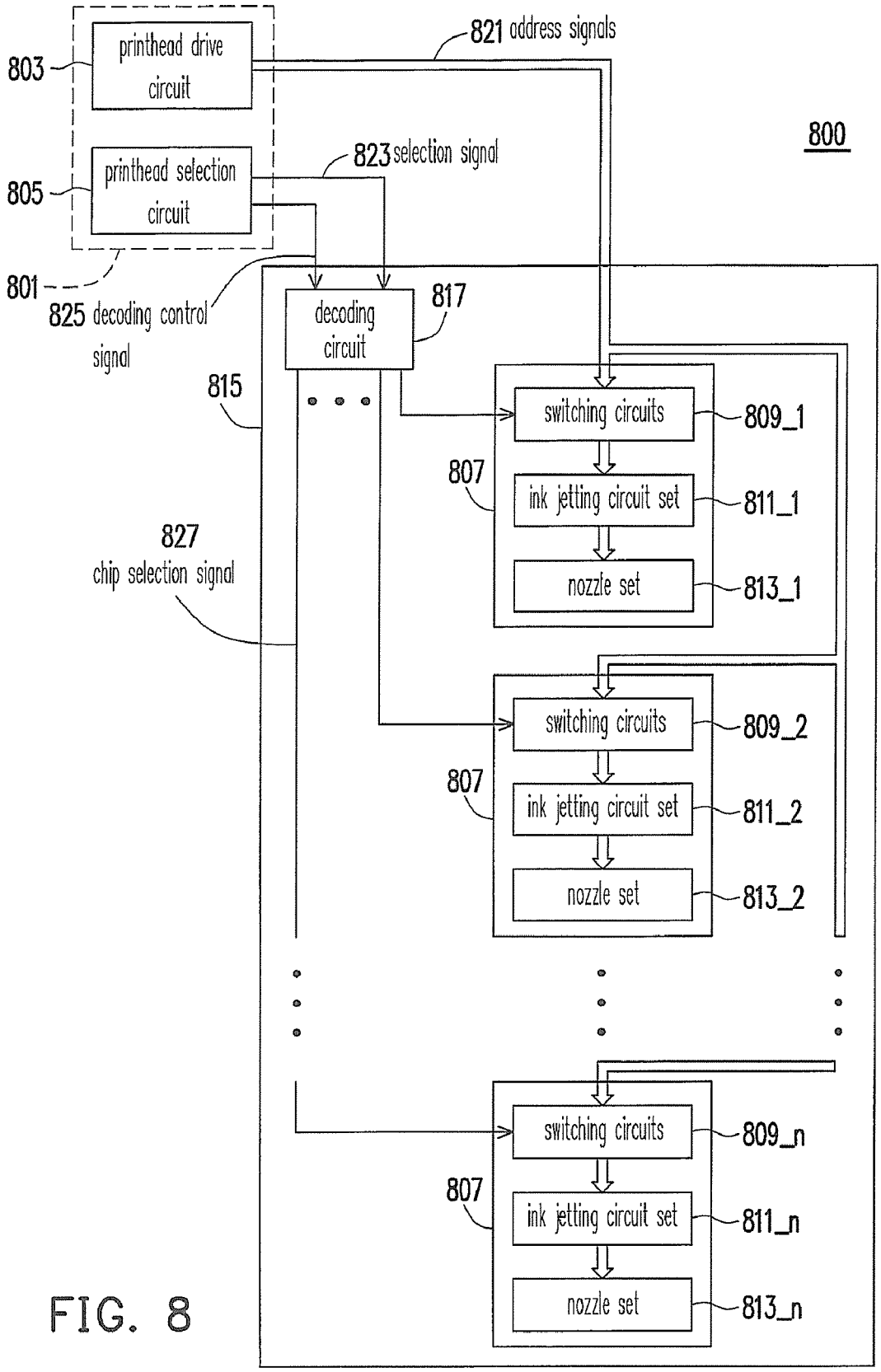
FIG. 8 is a block diagram of an ink jet printer in accordance with an embodiment of the present invention.

The forgoing buffer circuit 301 can be used as an embodiment of a switching circuit in an ink jet printhead module, as to be described. The printhead module is corresponding to a printing cartridge. FIG. 8 is a block diagram of an ink jet printer or printing apparatus in accordance with an embodiment of the present invention. In FIG. 8, the ink jet printer 800 includes a printhead drive unit 801. At least one printhead module 815 can be put into the ink jet printer 800 for printing. The printhead drive unit 801 includes a printhead drive circuit 803 and a printhead selection circuit 805. The ink jet printhead module 815 receives address signals 821, a selection signal 823 and at least one decoding control signal 825 from the printhead drive circuit 801. For example, the printhead drive circuit 803 provides the address signals 821, and the printhead selection circuit 805 provides at least one selection signal 823 and at least one decoding control signal 825.

The ink jet printhead module 815 includes a decoding circuit 817 and multiple chip control circuits 807, such as n number of control circuits. The decoding circuit 817 can be, for example, a demultiplexer circuit or a shift register circuit. The decoding circuit 817 receives the corresponding selection signal 823 and the corresponding decoding control signal 825 from the printhead selection circuit 805 and outputs multiple chip selection signals 827 to the corresponding chip control circuits 807, respectively. Each of the chip control circuits 807 receives the address signals 821 and the corresponding chip selection signal 827. Each of the chip control circuits 807 may be regarded as an ink jet printhead chip and includes multiple switching circuits 809, an ink jetting circuit set 811, and a nozzle set 813. The index number "_n" is added to indicate different switching circuits 809 (and ink jetting circuit set 811 and nozzle set 813) in different chip control circuits 807. Each of the switching circuits 809, for example, is the buffer circuit 301 in FIG. 3. The jetting circuit set 811 includes a plurality of ink jetting circuits. Each of the ink jetting circuits 811 electrically couples to the corresponding switching circuit 809 and includes, for example, multiple heaters H. The nozzle set 813 includes a plurality of nozzles in which each nozzle is corresponding to one or more heaters H. Each of the multiple switching circuits 809 in each of the chip control circuits 807 receives the corresponding one of the address signals 821. The switching circuits **809_1-809_*n* receive the address signals 821 from the printhead drive circuit 803 and a corresponding one of the chip selection signals 827 from the decoding circuit 817, and output a plurality of switching signals. Each of the ink jetting circuits receives the corresponding switching signal from the corresponding switching circuit electrically coupled to the ink jetting circuit and determines to jet ink from the corresponding nozzles of the nozzle set 813**.

In one embodiment of the present invention, the printhead module 815 includes n≧2 number of chip control circuits 807. In other words, in such embodiment, there is a plurality of chip control circuits 807 (ink jet printhead chips) in the printhead module 815, in which each of the chip control circuits 807 has corresponding multiple nozzles of the nozzle set 813. Therefore, width of a printing line can become larger due to multiple chip control circuits 807 and multiple nozzle sets 813 in the printhead module 815, and therefore the print speed can be enhanced. In order to provide the chip selection signal 827 to each chip control circuit 807, in one embodiment the decoding circuit 817 is used for decoding the selection signal 823 into multiple chip selection signals 827 for providing to chip control circuits 807, respectively. The decoding circuit 817 can be implemented in various manners. The examples for the decoding circuit 817 will be described later in FIG. 12 and FIG. 15. In another embodiment, the chip selection signals 827 can be provided directly from the printhead selection circuit 805 and respectively inputted to the chip control circuits 807 without requirement of the decoding circuit 817.

Figure 9:
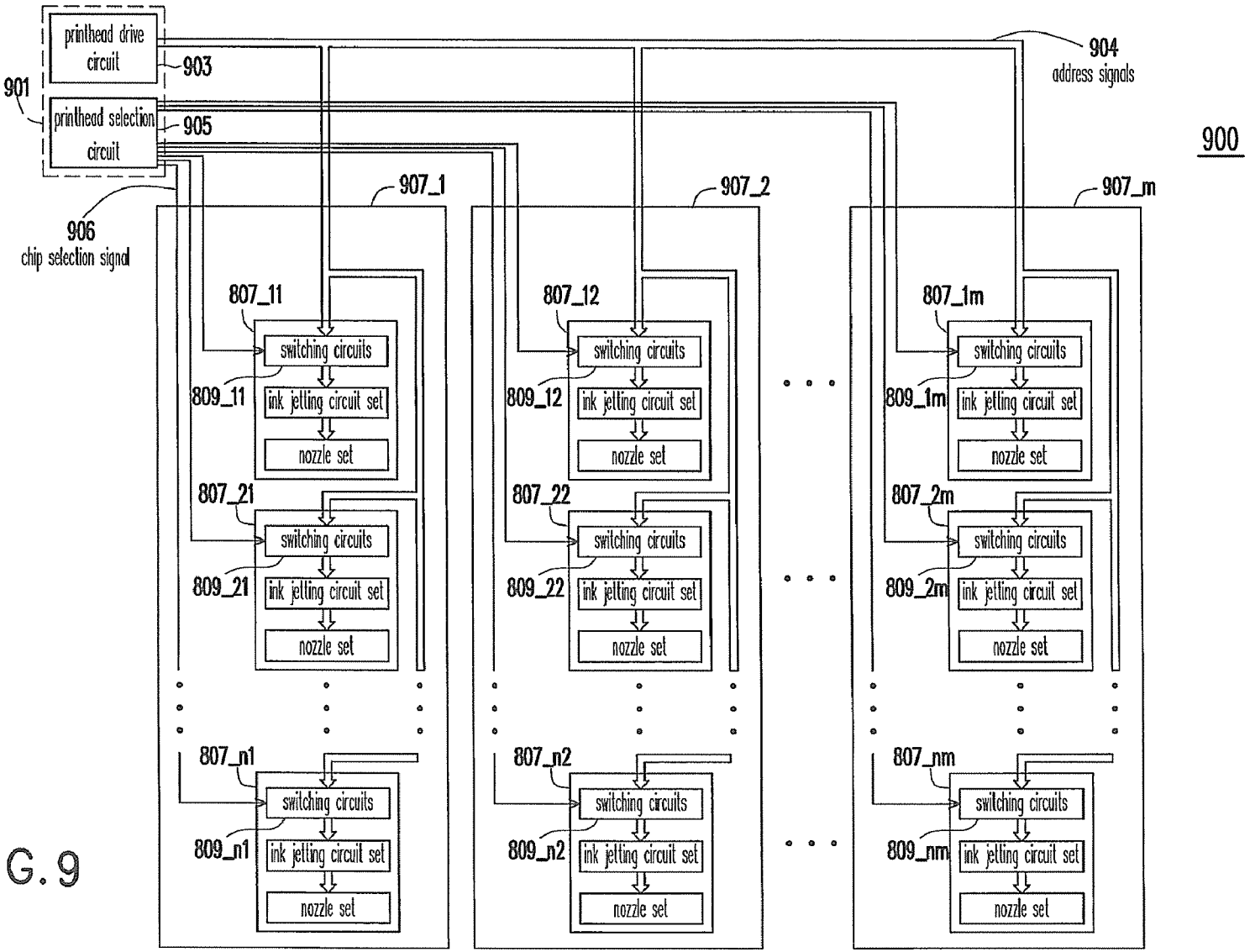
FIG. 9 is a block diagram of an ink jet printer in accordance with another embodiment of the present invention.

In one embodiment of the present invention, multiple ink jet printhead modules (e.g. multiple cartridges) can be put into a printing apparatus. FIG. 9 is a block diagram of an ink jet printer in accordance with an embodiment of the present invention. In FIG. 9, the ink jet printer 900 includes a printhead drive unit 901. The printhead drive unit 901 includes a printhead drive circuit 903 and a printhead selection circuit 905. In the embodiment shown in FIG. 9, each of the printhead modules 907 does not include the decoding circuit. Each of the chip selection signals 906 provided by the printhead selection circuit 905 is directly input to the corresponding one of the chip control circuits 807 of each of the printhead modules 907. The printhead drive circuit 903 outputs a plurality of address signals 904, and the printhead selection circuit 905 outputs a plurality of chip selection signals 906. The chip selection signals 906 are grouped into a plurality of selection groups with each selection group being provided to the corresponding one printhead module 907. Each selection group includes multiple chip selection signals 906. In FIG. 9, for example, the number of printhead modules is m (i.e. **907_1-907_*m*). The number of the chip control circuits in each of the printhead modules is n (i.e. 807_1-807_*n*). The numeral of "807_*nm*" indicates the $n^{th}$ chip control circuit in the $m^{th}$ printhead module. Generally, each of the ink jet printhead modules from 907_1 to 907_*m* receives the address signals 904 and a corresponding one group of the selection groups. Each selection group includes n chip selection signals 906. Each of the ink jet printhead modules 907 comprises n chip control circuits 807. Each of n chip control circuits 807 in each of the ink jet printhead modules 907 receives the address signals 904 and receives the corresponding one of the chip selection signals 906. Each of the chip control circuits 807, such as the chip control circuit 807_11, comprises a plurality of switching circuits 809_1, an ink jetting circuit set 811_1, and a nozzle set 813_1, as shown in FIG. 8. As similarly to those mentioned in the preceding description, the ink jetting circuit set 811_1 includes a plurality of ink jetting circuits. Each ink jetting circuit electrically couples to the corresponding one of the switching circuits 809_1 and includes, for example, multiple heaters H. The nozzle set 813_1 includes a plurality of nozzles in which each nozzle is corresponding to one or more heaters H in the ink jetting circuit of the jetting circuit set 811_1**.

The switching circuits **809_*nm* of the chip control circuit 807_*nm* receive the address signals 904 and the corresponding one of the chip selection signals 906 and output a plurality of switching signals. The ink jetting circuit set 811 receives the switching signals and jet inks from the nozzle set 813 based on the switching signals Specifically, each of the switching circuits 809 in each of the chip control circuits 807 receives the corresponding one of address signals 904 and the corresponding one of the chip selection signals 906 and outputs a corresponding switching signal. Each of the ink jetting circuits of the ink jetting circuit set 811 receives the corresponding switching signal from the switching circuit electrically coupled to the ink jetting circuit. The ink jetting circuit determines to jet ink from the corresponding nozzles of the nozzle set 813 based on the corresponding one of the address signals 904 received and the chip selection signal 906** when the power applied to the heater of the ink jetting circuit to jet ink is at the high voltage level.

Figure 10:
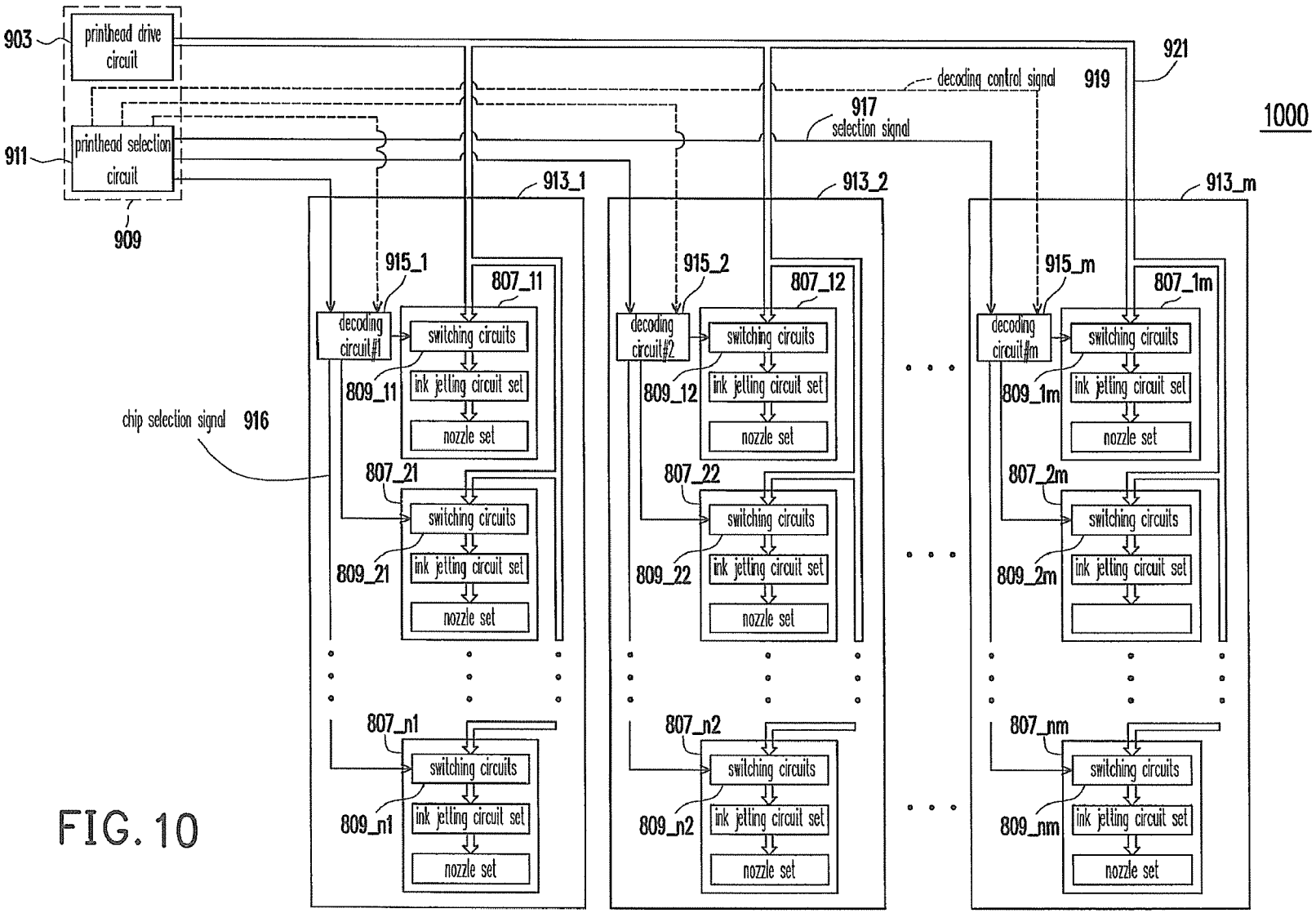
FIG. 10 is a block diagram of an ink jet printer in accordance with another embodiment of the present invention.

FIG. 10 is a block diagram of an ink jet printer 1000 in accordance with another embodiment of the present invention. In FIG. 10, the print drive unit 909 includes the printhead drive circuit 903 and the printhead selection circuit 911. The printhead drive circuit 903 provides the address signals 921. The printhead selection circuit 911 provides the selection signals 917 corresponding to the printhead modules **913_1-913_*m* respectively. Each of the printhead modules 913 is provided with a decoding circuit 915. The decoding circuit 915 in each of the printhead modules 913 receives at least one decoding control signal 919 provided by the printhead selection circuit 911 For example, the printing module 913_1 includes a decoding circuit 915_1 for receiving the corresponding selection signal 917 and the decoding control signal 919. The decoding circuit 915_1 decodes the selection signal 917 into a number of chip selection signals 916 for being provided to the chip control circuits 807_11-807_*n*1** respectively.

Figure 11:
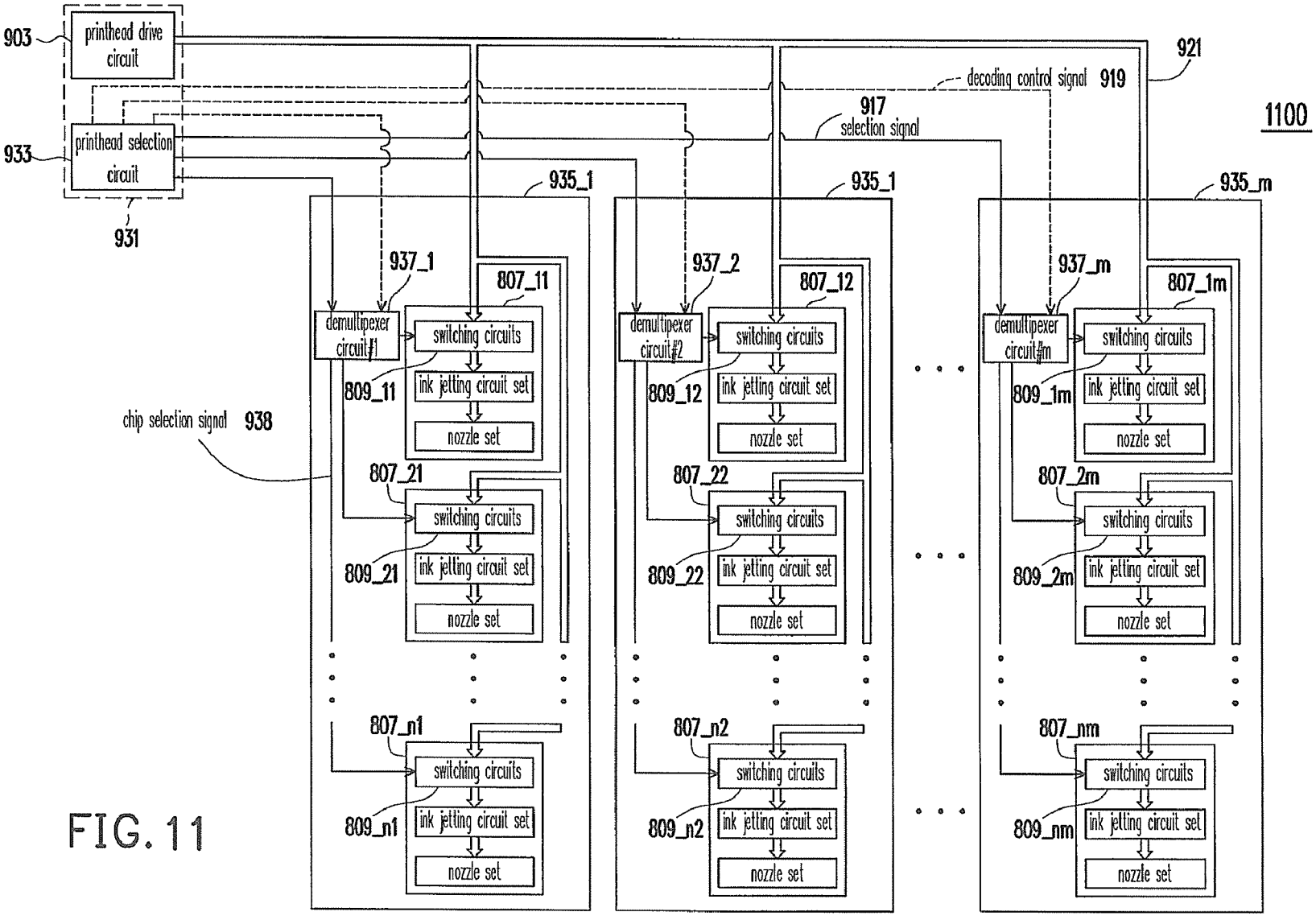
FIG. 11 is a block diagram of an ink jet printer in accordance with another embodiment of the present invention.

In this embodiment, the decoding circuit 915 can be any circuit or device, such as a demultiplexer circuit or a shift register circuit, for decoding the selection signal 917 from the printhead selection circuit 911. FIG. 11 is a block diagram of an ink jet printer 1100 in accordance with another embodiment of the present invention. In FIG. 11, the print drive unit 931 includes the printhead drive circuit 903 and the printhead selection circuit 933. Each of the printhead modules 935 is provided with a demultiplexer circuit 937 as the decoding circuit for providing the chip selection signals 938 to the chip control circuits 807, respectively. The printhead selection circuit 933 outputs one selection signal 917 and at least one decoding control signal 919 to each of the printhead modules **935_1-935_*m*. The decoding control signal 919 may carry the information to identify certain chip control circuit 807 in a printhead module 935. For example, the decoding control signal 919 may include a two-bit input signal or two one-bit input signals for indicating four chip control circuits 807**.

Figure 12:
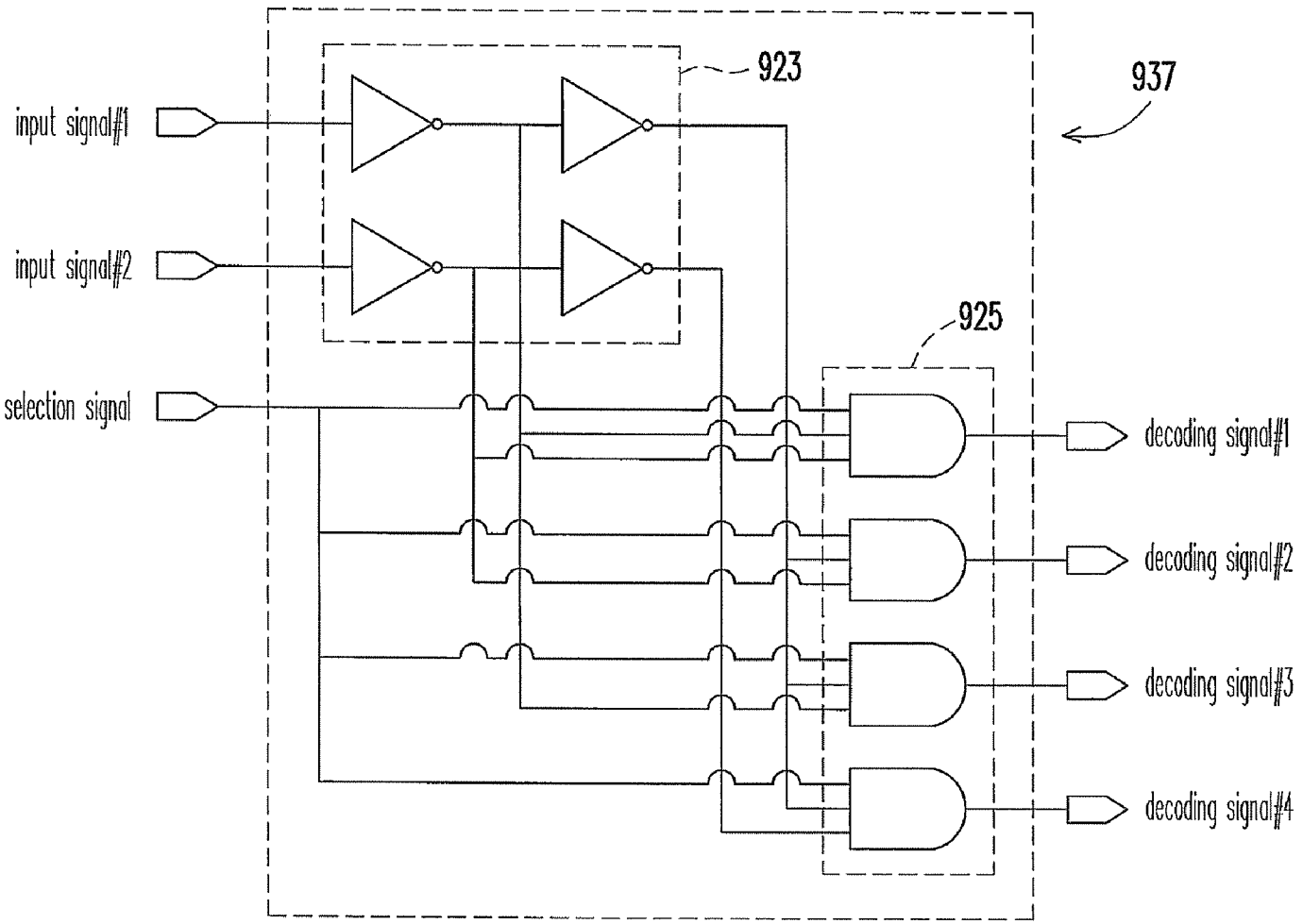
FIG. 12 is a block diagram of a demultiplexer circuit used in the ink jet printer of FIG. 11 in accordance with an embodiment of the present invention.

FIG. 12 is a block diagram of a demultiplexer circuit 937 used in the ink jet printer 1100 in FIG. 11 in accordance with an embodiment of the present invention. In FIG. 12, the number of chip control circuits is four, for example. The demultiplexer circuit 937 may receive two input signals (decoding control signals) and one selection signal. The input signals (decoding control signals) and the selection signal have a logic high voltage level and a logic low voltage level. The demultiplexer circuit 937 may include, for example, the logic circuit part 923 and the logic circuit part 925 so as to decode the selection signal 917 into four decoding signals serving as chip selection signals 938, which are respectively inputted to the chip control circuits 807 to selectively enable one of the chip control circuits 807 in the specific printhead module 935. In this embodiment, the relation between the number of output terminals of the demultiplexer circuit 937 (*n*) and the number of the input signals (x) is $n=2^x$ (i.e. the number of chip selection signals n equals to 2 power of x, in which x is the number of decoding control signals). Here, as can be understood, n=1 when x=0, in which only one chip control circuit is involved and there is no need of the decoding control signal. FIG. 13 shows the true-false table of the demultiplexer circuit 937 indicated in FIG. 12. In FIG. 13, the two input signals represent the content of two-bit. In this example, the logic circuit part 923 may be based on inverter logic units and the logic circuit part 925 may be based on AND logic units. However, it is not the only way to implement the demultiplexer circuit. The input signals are operated with the selection signal to obtain four decoding signals serving as the chip selection signals 938 for indicating the four chip control circuits 807.

Figure 14:
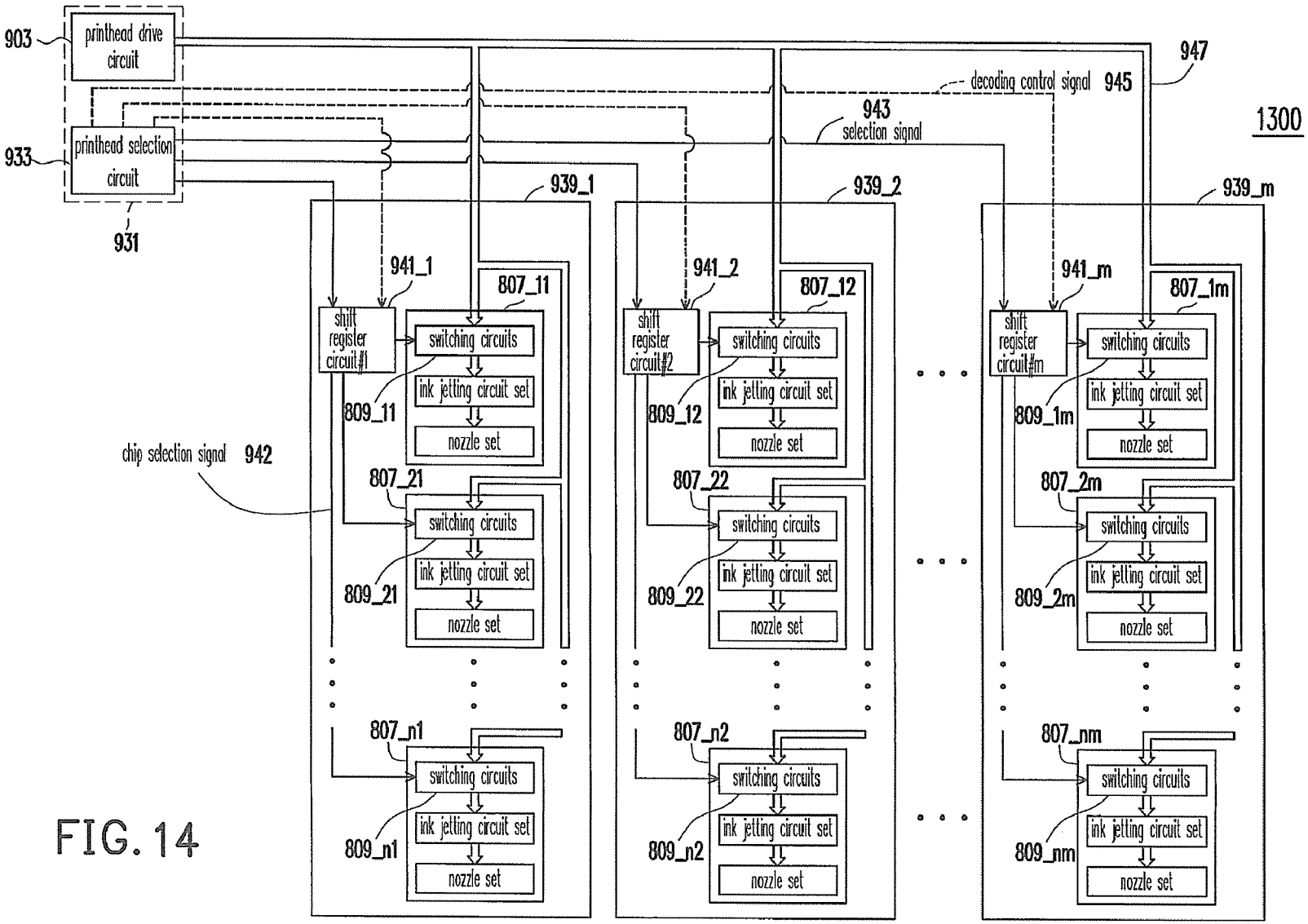
FIG. 14 is a block diagram of an ink jet printer in accordance with another embodiment of the present invention.

The decoding circuit 915 can also be implemented with a shift-register circuit, for example. FIG. 14 is a block diagram of an ink jet printer 1300 in accordance with another embodiment of the present invention. In FIG. 14, the print drive unit 931 includes the printhead drive circuit 903 and the printhead selection circuit 933. Each of the printhead modules 939 includes the shift register circuit 941. The shift register circuit 941 receives the decoding control signal 945 and the selection signal 943, and then outputs the chip selection signals 942. The printhead drive circuit 903 outputs address signals 947. The printhead selection circuit 933 outputs a serial selection signal 943 and the decoding control signal 945 to each of the printhead modules **935_1-935_*m*. The decoding control signals 945** in this example can be a clock signal.

Figure 15:
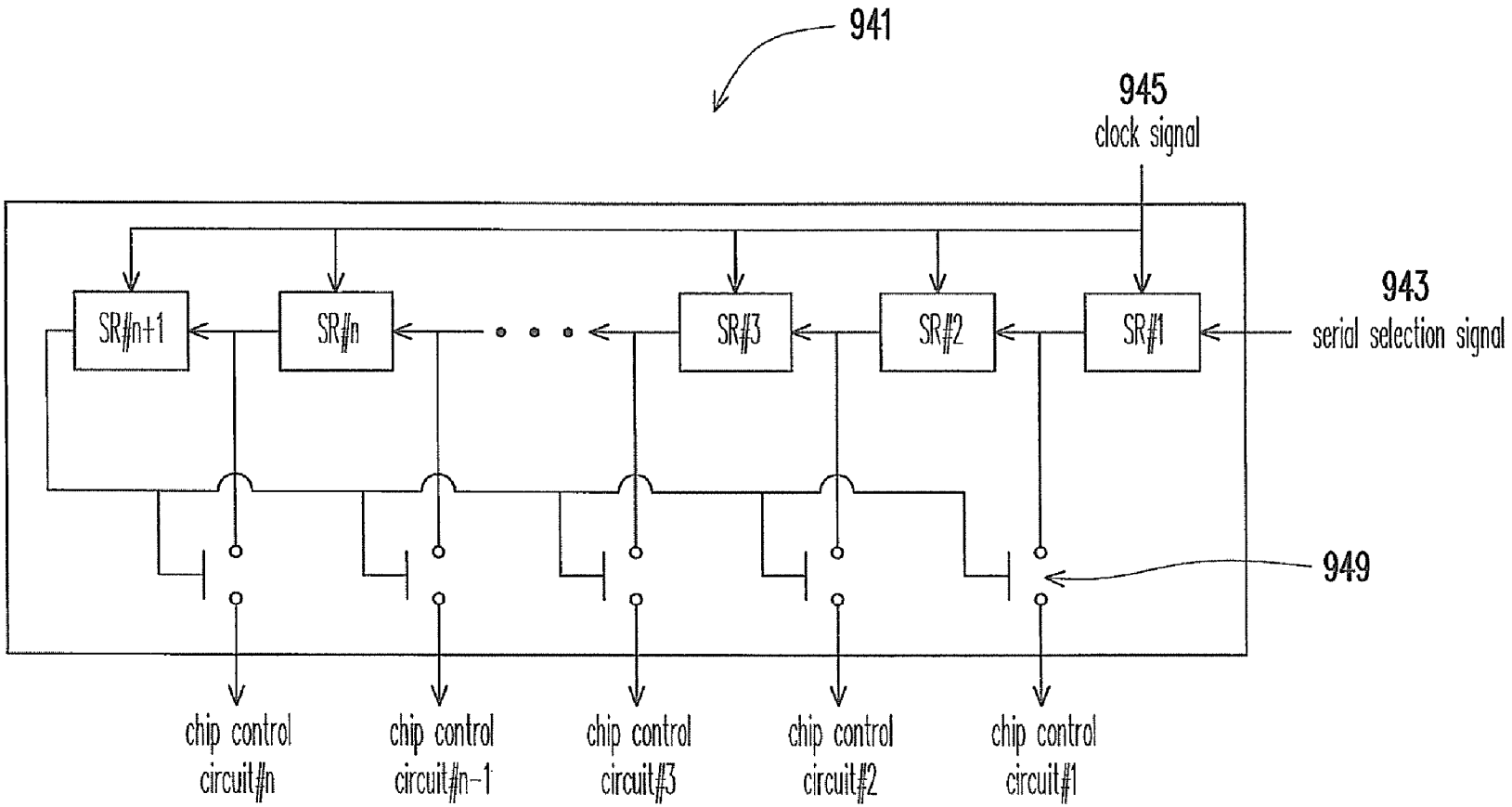
FIG. 15 is a block diagram of a shift register circuit used in the ink jet printer of FIG. 14 in accordance with another embodiment of the present invention.

FIG. 15 is an example of a block diagram of a shift register circuit used in the ink jet printer of FIG. 14 in accordance with another embodiment of the present invention. The number of chip control circuits 807 in one printhead module 935 is n. The shift register circuit 941, for example, includes several shift register stages SR#1-SR#n+1. The shift register stages can be flip-flop units or other circuit from inverters, for example. The shift register (SR) stages are electrically coupled in series and receive a serial selection signal. Each shift register stage receives the clock signal for shifting the serial selection signal. The output terminal of each SR stage is electrically coupled with a switch 949 while the last one of the SR stage outputs the leading signal to turn on the switches 949 so as to respectively input the serial selection signal from the corresponding shift register stage to the corresponding one chip control circuit 807.

In this embodiment, for example, the serial selection signal 943 includes a leading binary data with "1", which induces a logic high voltage level. After the leading binary data, the serial of n binary data corresponding to the chip control circuits 807 are sequentially input as a serial signal. For example, if four chip control circuits 807 are in one printhead module 939, the serial selection signal 943 can be 1xxxx, in which xxxx contains four bits of serial binary data to respectively and selectively enable the corresponding chip control circuit 807. When the leading information "1" is shifted to the SR#n+1, it produces the turning on signal to all of the switches 949 for outputting the chip selection signals 942. In order to turn on the switches 949, one more additional SR can be used to generate the turning-on voltage to the switches 949. Again, the shifting registering circuit 941 in FIG. 15 is one example and is not necessary to be the only one implementation of the present invention.

The embodiments of the present invention feature a printhead module having multiple chip control circuits. Each chip control circuit receives a plurality of address signals provided by the printhead drive circuit of the ink jet printing system and a chip selection signal provided directly or indirectly by the printhead selection circuit of the ink jet printing system. When the switching circuit in a chip control circuit of a printhead module receives an address signal and a chip selection signal at the logic high voltage level, the switching circuit outputs a switching signal to a corresponding ink jetting circuit having one or more heaters and jet out ink from the nozzle corresponding to the activated heater. It should be noted that the address signal used in the printhead is used to selectively enable the desired ink jetting circuit. The switching signal is determined from the logic voltage levels of the chip selection signal and the address signal. The switching signal then selectively enables the ink jetting circuit to turn on the switch device (e.g. transistor) that is electrically connected to the heater when the address signal and the selection signal are at the logic high voltage level.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An ink jet printhead module adapted for use in a printing apparatus, the ink jet printhead module being capable of receiving a plurality of address signals and a plurality of chip selection signals from a printhead drive unit of the printing apparatus, the ink jet printhead module comprising:

a plurality of chip control circuits, each of the chip control circuits being capable of receiving the address signals and receiving a corresponding one of the chip selection signals, wherein each of the chip control circuits comprises:

a plurality of switching circuits, each of the switching circuits being capable of receiving a corresponding one of the address signals and the corresponding one of chip selection signals and outputting a switching signal; and an ink jetting circuit set, including a plurality of ink jetting circuits, each of the ink jetting circuits being capable of receiving the switching signal from the corresponding switching circuit electrically coupled to the ink jetting circuit and determining whether or not to jet out ink based on the received switching signal, and wherein the corresponding one of address signals and the corresponding one of the chip selection signals have a voltage level of a logic high voltage level and a logic low voltage level, the switching signal is a logic high voltage level and selectively enables the ink jetting circuit when the corresponding one of the address signals and the corresponding one of chip selection signals are at the logic high voltage level.

2. The ink jet printhead module of claim 1, wherein each of the switching circuits comprises at least a first inverter and a second inverter coupled in series, the first inverter receives the corresponding one of the chip selection signals, each of the inverters receives the same corresponding one of the address signals, and the second inverter outputs the switching signal.

3. The ink jet printhead module of claim 2, wherein each of the inverters includes a FET.

4. The ink jet printhead module of claim 3, wherein each of the switching circuits comprises:

a first resistor, having a first terminal for receiving the corresponding one of the address signals;

a first FET, having a first terminal being coupled to a second terminal of the first resistor and outputting an inverted signal, a second terminal for receiving the corresponding one of the chip selection signals, and a third terminal being coupled to a ground;

a second resistor, having a first terminal for receiving the corresponding one of the address signals; and a second FET, having a first terminal being coupled to a second terminal of the second resistor and outputting the switching signal, a second terminal for receiving the inverted signal, and a third terminal being coupled to the ground.

5. An ink jet printer, comprising:

a printhead drive unit, comprising a printhead drive circuit and a printhead selection circuit, the printhead drive circuit being capable of outputting a plurality of address signals, the printhead selection circuit being capable of outputting a plurality of chip selection signals; and at least one ink jet printhead module, the ink jet printhead module being capable of receiving the address signals and the chip selection signals, wherein the ink jet printhead module comprises:

a plurality of chip control circuits, each of the chip control circuits being capable of receiving the address signals and a corresponding one of the chip selection signals, wherein each of the chip control circuits comprises:

a plurality of switching circuits, each of the switching circuits being capable of receiving a corresponding one of the address signals and the corresponding one of the chip selection signals and outputting a switching signal; and an ink jetting circuit set, including a plurality of ink jetting circuits, each of the ink jetting circuit being capable of receiving the switching signal from the corresponding switching circuit electrically coupled to the ink jetting circuit and determining whether or not to jet out ink based on the received switching signal, and wherein the corresponding one of the address signals and the corresponding one of the chip selection signals have a voltage level of a logic high voltage level and a logic low voltage level, the switching signal is a logic high voltage level and selectively enables the ink jetting circuit when the corresponding one of the address signals and the corresponding one of the chip selection signals are at the logic high voltage level.

6. The ink jet printer of claim 5, wherein each of the switching circuits comprises a first inverter and a second inverter electrically coupled in series, the first inverter receives the corresponding one of the chip selection signals, each of the inverters receives the same corresponding one of the address signals, and the second inverter outputs the switching signal.

7. The ink jet printer of claim 5, wherein each of the inverters includes a FET and each of the switching circuits includes:

a first resistor, having a first terminal for receiving the corresponding one of the address signals;

a first FET, having a first terminal being coupled to a second terminal of the first resistor and outputting an inverted signal, a second terminal for receiving the corresponding one of the chip selection signals, and a third terminal being coupled to a ground;

a second resistor, having a first terminal for receiving the corresponding one of the address signals; and a second FET, having a first terminal being coupled to a second terminal of the second resistor and outputting the switching signal, a second terminal for receiving the inverted signal, and a third terminal being coupled to the ground.

* * * * *